United States Patent [19]

Kappler et al.

[11] 4,163,517

[45] Aug. 7, 1979

[54] TUBULAR CONTAINER

[75] Inventors: Hermann Kappler, Bayside, N.Y.; Norman A. Chezek, Clifton, N.J.

[73] Assignee: Niemand Bros., Inc., Elmhurst, N.Y.

[21] Appl. No.: 915,667

[22] Filed: Jun. 15, 1978

[51] Int. Cl.[2] ..... B65D 3/10

[52] U.S. Cl. ..... 229/45

[58] Field of Search ..... 229/4.5, 21; 220/289, 220/266; 215/252, 253

[56] References Cited

U.S. PATENT DOCUMENTS

| | | | |
|---|---|---|---|
| 2,898,025 | 8/1959 | Walker | 229/4.5 |
| 2,969,902 | 1/1961 | Cage | 229/4.5 |
| 3,014,630 | 12/1961 | Whelam et al. | 229/4.5 |
| 3,162,346 | 12/1964 | Geist | 229/4.5 |
| 4,008,846 | 2/1977 | Gordon | 229/4.5 |
| 4,051,992 | 10/1977 | Bergstein | 229/21 |

*Primary Examiner*—Davis T. Moorhead

*Attorney, Agent, or Firm*—Kane, Dalsimer, Kane, Sullivan and Kurucz

[57] ABSTRACT

The disclosure is of a tamper-proof tubular container, which comprises: a tubular body including a detachable or removable body wall portion contiguous with one end, a plug for the opposite end and a removable closure member mounted on the inner surface of the removable portion. Frangible means permits detachment of the removable portion. The closure member has a threaded portion in contact with the inner surface of the tubular wall, to facilitate removal and replacement of the closure member. The container of the invention is particularly advantageous in that it is lightweight, tamper-proof, secure after opening and replacement of the closure member and is easier to employ for multiple opening and reclosures. The disclosure is also of a self-threading closure member for use in association with tubular-type containers.

11 Claims, 8 Drawing Figures

TUBULAR CONTAINER

BACKGROUND OF THE INVENTION

1. Field of the Invention

The invention relates to containers and more particularly relates to tubular containers and reclosable closure members therefore.

2. Brief Description of the Prior Art

FIG. 1 is an isometric view of a prior art tubular container of the type improved by the present invention. In FIG. 1, the prior art tubular container is shown in disassembly for convenience in viewing. As shown in FIG. 1, the prior art, tamper-proof, tubular containers 10 comprise a tubular body portion 12 having a first open end 14 and a second open end 18. Partially fitted within the tubular body 12 and held by frictional engagement with the inner walls of body 12, is an inner tubular sleeve 16. At end 14 of tubular body 12, sleeve 16 protrudes to form a neck 20. At end 18 of the body 12, sleeve 16 is withheld from end 18 to expose surface 28 on the inner side of body 12. The end 18 is closed by the mounting of plug 30 therein. Plug 30 comprises a tubular member 34 having one closed end 36 with a retaining flange 38 circumscribing the member 34 at end 36. To facilitate assembly of the plug 30 into end 18 of body 12, the leading edge of member 34 has a bevel 32. Around the periphery of member 34 are raised ribs 35 which ensure a tight frictional fit with surface 28 on the inside of body 12 when plug 30 is mounted therein. The neck 20 of sleeve 16 is initially covered by a removable portion 19 which initially is a formed part of the tubular body 12. The removable portion 19 of tubular body 12 is delineated by a frangible scoreline 22A, 22B and is initially joined together by frangible tabs 24A, 24B shown broken in FIG. 1. Thus, in assembly, removable portion 19 is physically joined at its end 48 to the tubular body 12 through joined frangible tabs 24A, 24B. The opposite end 49 of removable portion 19 is closed by plug 40 which comprises a tubular member 42 having a lead beveled edge 44 and a closed end 46. In fact, plug 40 is structurally identical to the plug 30 previously described and includes raised ribs 43 which serve to make a tight frictional engagement between plug 40 and the inner surface of the removable portion 19.

Referring now to FIG. 2, an isometric view-in-part of the prior art tubular container of FIG. 1, one can see the assembled, removable portion 19 secured to the tubular body 12 by tabs 24, and delineated by a scoreline 22. The plug 40 is in place to secure the upper end of the tubular container 10 and the plug 30 (not shown in FIG. 2) secures the lower end 18. In operation, one opens the container 10 by first grasping the removable portion 19 (including plug 40) with one hand and the tubular body 12 with the other hand. By twisting parts 19, 12 in opposite directions, the frangible tab 24 is broken to separate into broken tabs 24A, 24B as shown in FIG. 1. The operator then pulls the removable portion 19 together with plug 40 in a direct pull along the axis of the arrow "A" shown in FIG. 2, to open and gain access to the contents of the tubular container 10.

Tamper-proof, tubular containers of the type shown in FIGS. 1 and 2 have not been entirely satisfactory for all purposes. First, the requirement for inner sleeve 16 substantially increases the weight of the container package. This is, of course, an economic disadvantage both in labor, cost of manufacture, and shipping costs. In addition, the direct pulling away of the removable portion 19 from tubular body creates a partial vacuum within the tubular container 10. If the contents of the container 10 are flaky or powdery materials, the creation of a vacuum and turbulence within the container 10 by the direct outward pull may cause the container contents to partially fly out of the container 10 upon its opening. In addition, it will be appreciated by those skilled in the art that replacement of the removable portion 19 with its included mounted plug 40, over the neck 20 of sleeve 16 is not a tight fitting replacement. Of necessity, due to its construction, the inner surface of the removable portion 19 is in a bare sliding fit with the neck 20. Thus, if the container 10 falls over on its side, there is potential for the removable portion 19 together with plug 40 by its weight alone to separate from the tubular body 12 and allow the contents of the tubular container 10 to spill out. This, of course, is an undesirable feature of the prior art tubular container 10.

The improved, tamper-proof, tubular container of the present invention obviates a number of the disadvantages found in the prior art containers of the tubular type. For example, the container of the invention is of a lighter construction with a more secure closure. These advantages will be discussed hereinafter more fully with other advantages.

SUMMARY OF THE INVENTION

The invention comprises an improved, tamper-proof, tubular container assembly which comprises:

a tubular body having a closed end, an open end, a body wall with inner and outer surfaces joining said ends and a removable body wall portion contiguous with the open end, said inner surface being deformable;

means associated with the body wall for fracturing said body wall and permanently separating the removable body wall portion, whereby access to the contents of the container assembly may be had; and a removable closure member, mounted in and closing the open end of the tubular body, said closure member comprising a hollow cylinder having (a) a first closed end;

(b) a second, beveled end, said bevel being angled toward the axis of said cylinder;

(c) a cylinder wall joining the first and second ends and having inner and outer surfaces, said outer surface being divided into a screw thread zone which is contiguous with the beveled end and an attachment zone between the screw thread zone and the first closed end; and (d) a male screw thread formed on the outer surface of the cylinder in the screw thread zone;

said mounting being effected by securing the inner surface of the removable body wall portion of the tubular body to the attachment zone of the hollow cylinder, with the beveled end and screw thread zone positioned within said tubular body at a point between the closed end of the tubular body and the removable body wall portion;

the removable closure member being of a dimension whereby the screw thread will deform the inner surface of the tubular body when the removable closure member is mounted in the open end of the tubular body, and form thereon a corresponding female screw thread in which the male screw thread will slide when the removable closure member is rotated so as to screw the closure member out of the open end of the tubular body.

DETAILED DESCRIPTION OF THE PREFERRED EMBODIMENTS OF THE INVENTION

Figure 3:
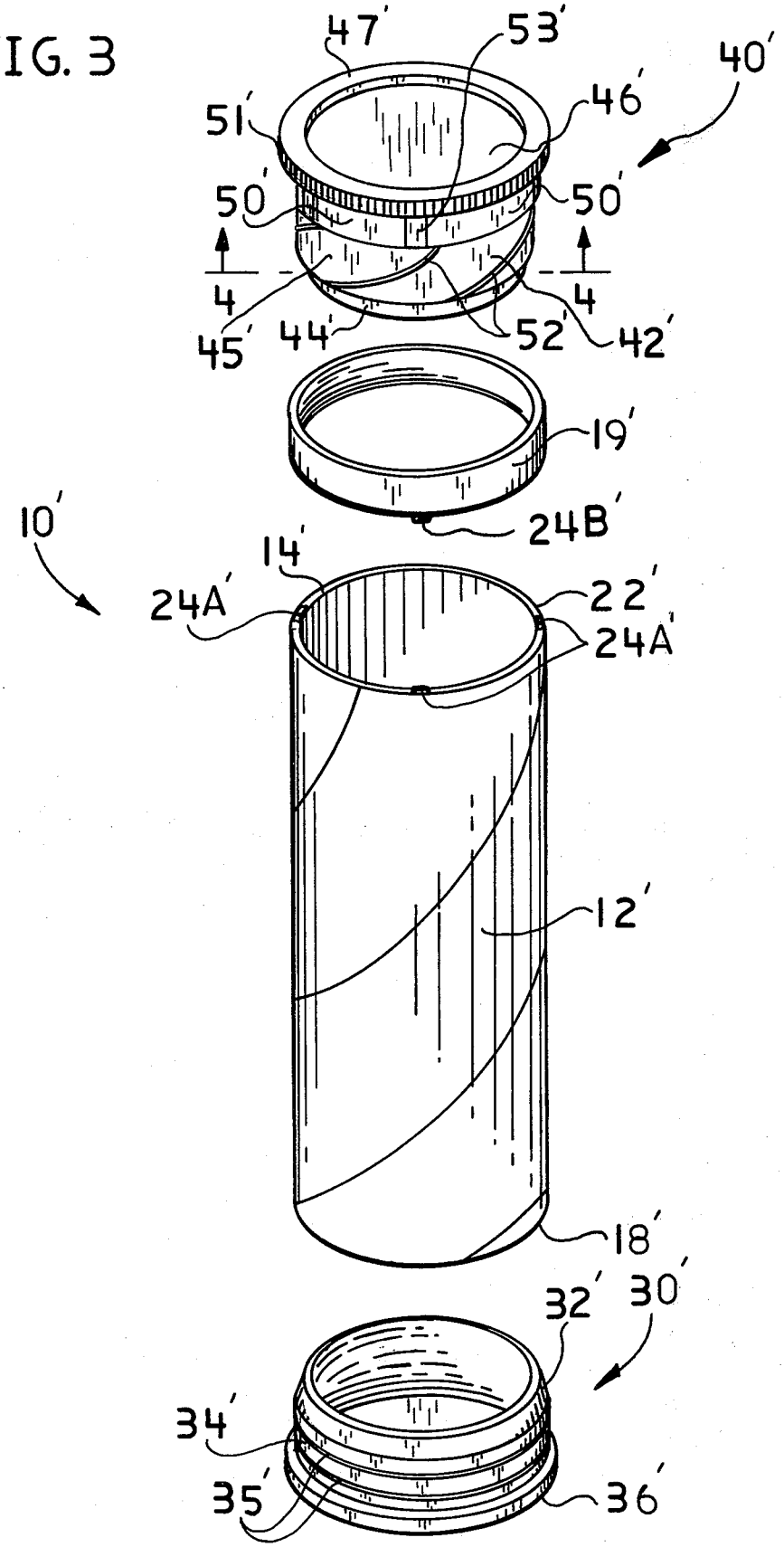
FIG. 3 is an isometric view of an embodiment container of the invention, shown disassembled.

FIG. 3 is an isometric view of a preferred embodiment, tamper-proof, tubular container of the invention. As shown in FIG. 3, the embodiment tubular container 10′ is in disassembly for easier viewing. The embodiment tubular container 10′ comprises a tubular body 12′ of a spirally wrapped paper. Methods of manufacturing such bodies are well known in the art. The tubular body 12′ has a first open end 14′ and a second open end 18′. The open end 18′ is closed by emplacement of a plug 30′ which comprises a hollow cylinder 34′ having one open end defined by a beveled surface 32′ and a second closed end 36′. Circumscribing the body of cylinder 34′ are raised ribs 35′ which function to provide a frictional fit between the interior of the tubular body 12′ at end 18′ and plug 30′ when the plug 30′ is mounted therein to close end 18′ of the tubular body 12′. A removable portion 19′ is initially an integrated part of tubular body 12′; joining it at the scoreline 22′. Joinder of removable portion 19′ with the remainder of tubular body 12′ is effected through the frangible tabs portions 24A′ and 24B′ which are shown in FIG. 3 broken and separated. Closing the upper end 14′ of tubular container 10′ is a removable closure member 40′ which consists of a hollow cylinder 42′ the outer periphery of which is divided into three zones. An attachment zone 50′ is contiguous with the upper closed end 46′ of the closure member 40′. A beveled surface zone 44′, with the bevel directed inwardly towards the axis of the cylinder 42′ defines the periphery of the lower open end of cylinder 42′. Between bevel zone 44′ and attachment zone 50′ is a screw thread zone 45′ upon which there is integrally formed male screw threads 52′. Around the periphery of its closed end 46′ is a flange 47′ having a slotted or finger-grasping surface 51′. It will also be seen that integrally formed on the attachment zone 50′ are a plurality of raised attachment lugs 53′, evenly spaced apart. The removable closure member 40′ is secured permanently by frictional engagement to the inner surface of the removable portion 19′, through impingement of the raised mounting lugs 53′ on the inner surface of the removable portion 19′. When closure member 40′ is attached to removable portion 19′ and mounted in the open end 14′ of tubular body 12′, the threaded zone 45′ and bevel surface (to facilitate assembly and reclosure) 44′ are positioned within the tubular body 12′, at a point between the closed end 18′ and the removable portion 19′. The dimensions of the removable closure are such that the male screw threads 52′ will lightly embed in the spiral paper surface of tubular body 12′ and by deformation of body 12′ form therein corresponding female threads.

Figure 1:
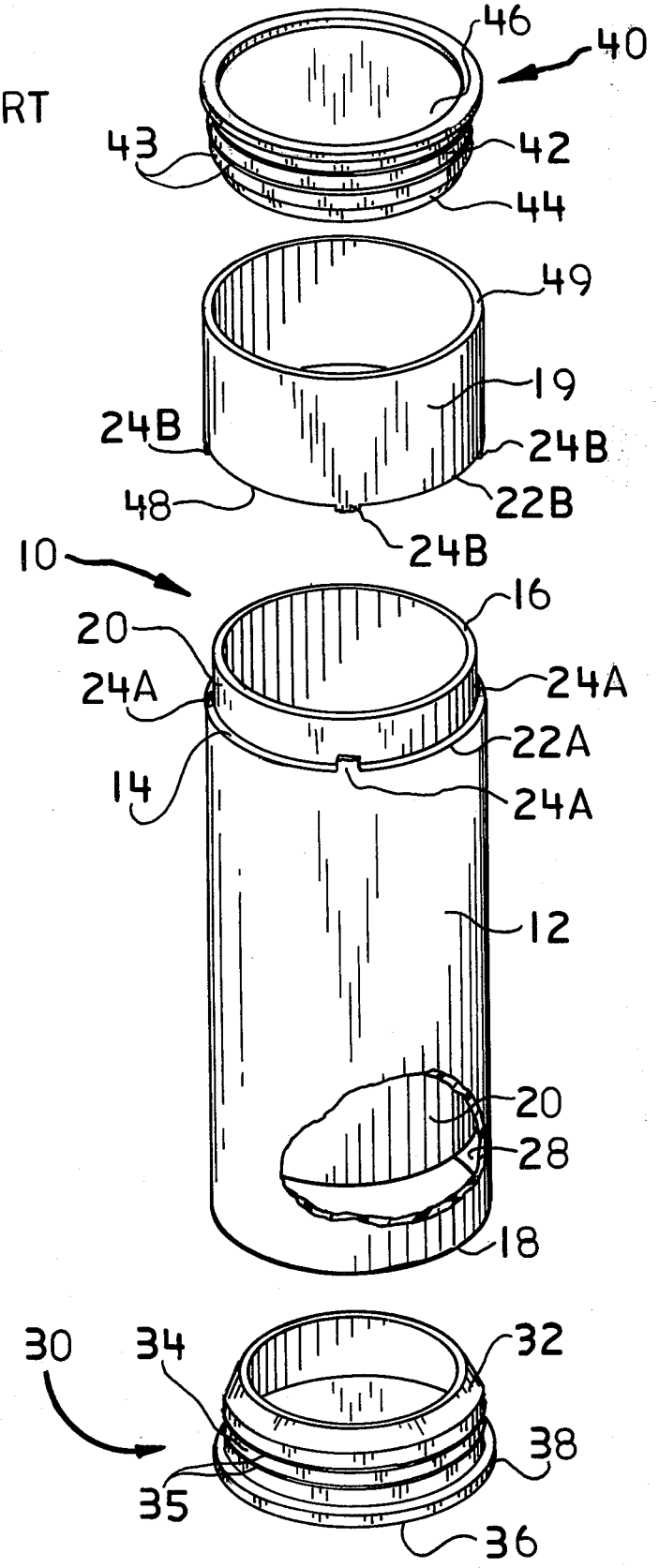
FIG. 1 PRIOR ART
FIG. 1 is an isometric view of a prior art container, shown disassembled.
Figure 2:
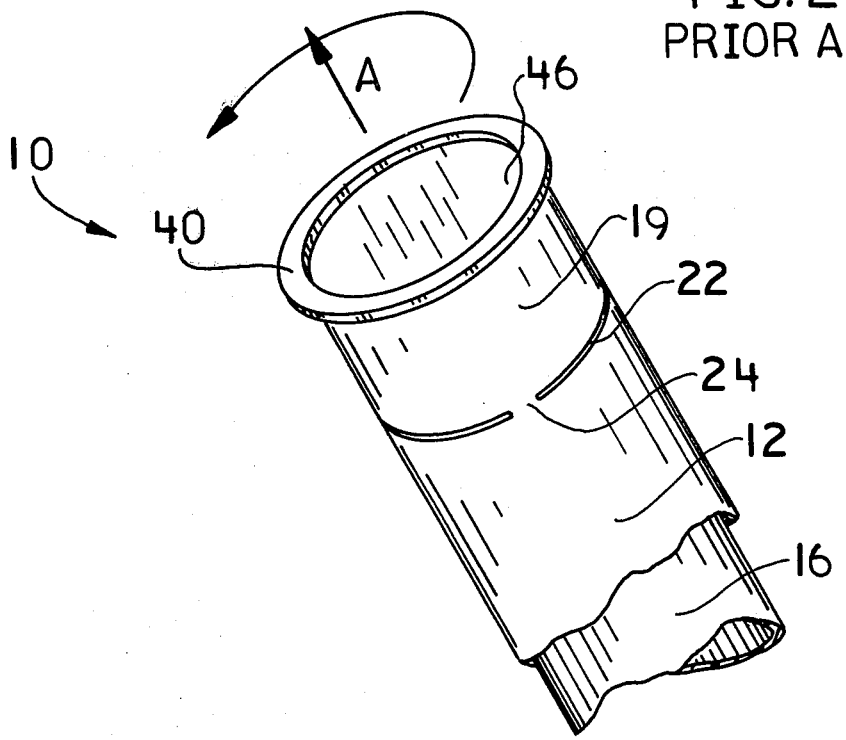
FIG. 2 PRIOR ART
FIG. 2 is an isometric view-in-part of the container of FIG. 1, shown assembled.
Figure 4:
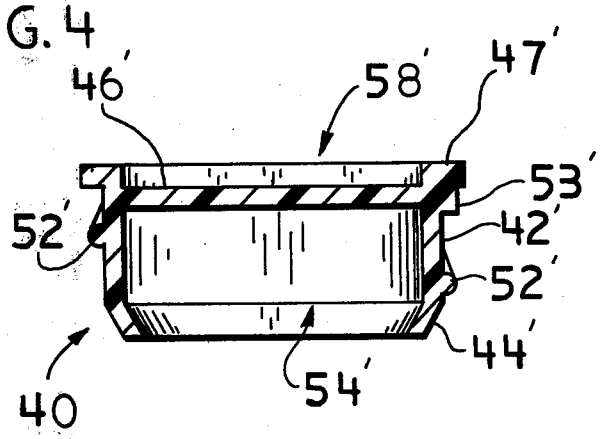
FIG. 4 is a cross-sectional view along lines 4—4 of FIG. 3.

FIG. 4 is a cross-sectional view along lines 4—4 of FIG. 3 and shows further structural features of the closure member 40′. FIG. 4 shows that the closure member 40′ is a hollow cylinder with an open end 54′ and a closed end 46′ to reduce the overall weight of the closure member 40′. This is an advantage when the closure member 40′ is fabricated from a preferred material, i.e.; a synthetic polymeric resin such as polyvinyl chloride. The end 46′ is depressed beneath the level of grasping flange 47′ to facilitate gripping the periphery of the closure member 40′ and also to provide a closure 40′ free of mold marks for aesthetic purposes.

In FIG. 3, it will be observed that the male screw threads 52′ do not circumscribe the periphery of thread zone 45′, but are in fact a plurality of screw thread segments with a pitch such that they originate at the attachment zone 50′ and terminate at the bevel surface 44′. This is a preferred embodiment construction of the invention, permitting one to remove the closure member 40′ from engagement with the tubular body 12′ with a simple 90° twist as will be described hereinafter. However, as an alternate construction the male screw threads 52′ can also circumscribe the periphery of the thread zone 45′ as shown in FIG. 5.

Figure 5:
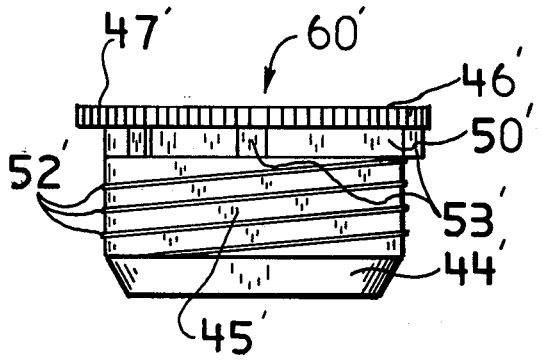
FIG. 5 is a side elevation of an alternate embodiment closure member employed in the container of FIG. 3.

FIG. 5 is a side elevation of an alternate embodiment removable closure 60′, wherein structural parts analogous to those of closure 40′ are similarly identified by the numerical symbols. The chief difference between closures 40′ and 60′ resides in the male screw thread 52′ which is a single continuous thread in the closure 60′, circumscribing a number of times the periphery of screw thread zone 45′.

Figure 6:
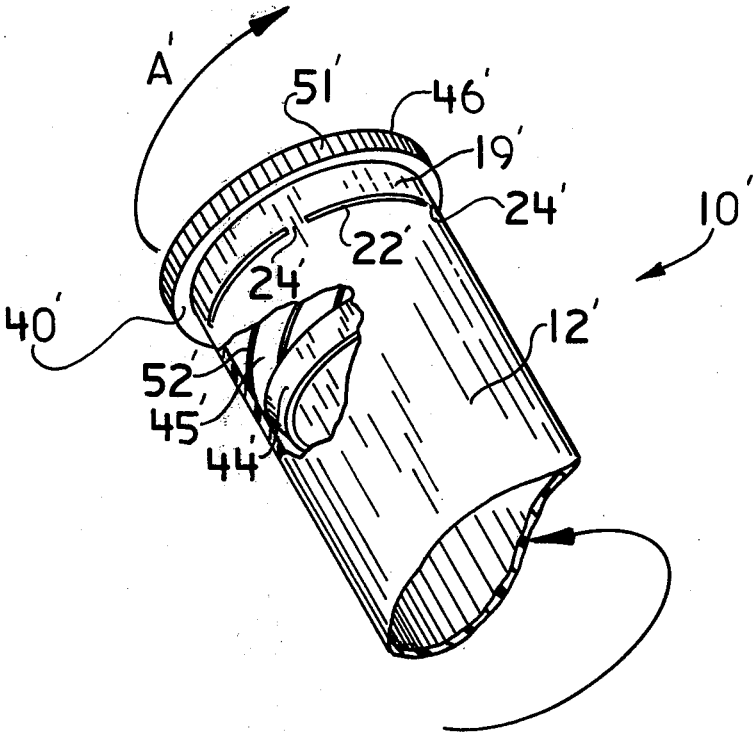
FIG. 6 is an isometric view-in-part, of the container of the invention shown in FIG. 3, assembled.

Referring now to FIG. 6, an isometric view-in-part of the container 10′, the advantageous operation of the container may be appreciated. As shown in FIG. 6, the removable portion 19′ is secured to tubular body 12′ through the unbroken frangible tabs 24′ which are the unperforated portions of the perforated seam 22′, circumscribing the tubular body 12′. The closure member 40′ is firmly sealed in the open end 14′ of the body 12′. If the container 10′ is opened, the frangible tabs 24′ are broken as a visible indication that the container 10′ has been opened. The container is therefore "tamper-proof". To open the container 10′, the operator holds the tubular body 12′ in one hand and the grasping flange surface 51′ in the other hand. By twisting the parts 12′, 51′ as shown by the arrows, the frangible tabs 24′ break and the closure member 40′ with attached removable portion 19′ will spiral out of the end 14′ of body 12′, following the direction of the arrow "A'". The closure member 40′ screws out on the screw threads 52′ which follow the course of the corresponding female screw threads previously described as impressed in the deformable paper forming the tubular body 12′. As the closure member 40′ unscrews, air passes into the body 12′ to fill the space previously occupied by the closure member, through the space between adjacent male screw threads 52′, in a gentle manner so the contents of the container 10′ are not significantly disturbed as previously described for the prior art container 10. To reclose the container 10', the closure member 40' is threaded back into the end 14' of tube body 12'. The tight fit obtained assures that even if the container 10' falls over, the closure member 40' is unlikely to fall out, releasing contents of the container 10'.

It will be appreciated that in comparison to the prior art container 10, the embodiment container 10' is of a lighter weight, with a more secure closure member. Overall, a more economical, more secure package is obtained. If the closure member 40' has the embodiment screw threads shown in FIG. 3, the member 40' may be removed with a simple 90° turn of the closure member 40'. If the screw threads 52' are the continuous type shown in FIG. 5, the closure member 40' will have to be rotated more than 90° to remove the member 40' from its mounting in the end 14' of tubular body 12'.

Figure 7:
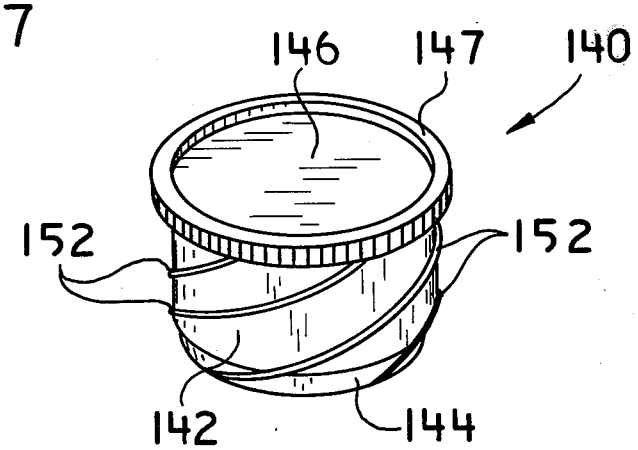
FIG. 7 is an isometric view of another embodiment closure of the invention.
Figure 8:
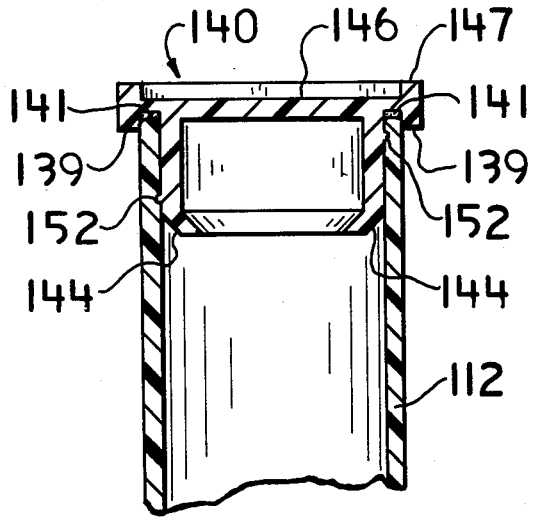
FIG. 8 is a cross-sectional side elevation of the embodiment of FIG. 7, shown mounted in the open end of a container.

Those skilled in the art will appreciate that one of the novel features of the invention is the use of a self-threading closure member for closing tubular containers of the type described above. Referring now to FIG. 7, one may observe an isometric view of an embodiment closure, wherein parts analogous to parts of the member 40 have been similarly numbered, but increased by a factor of 100. The closure member 140 comprises a cylindrical body 142 having a closed end 146 and a beveled lower end 144, with the bevel directed inwardly towards the axis of the cylinder body 142. The upper closed end 146 is circumscribed by a finger-grasping flange 147. Interrupted, integrally formed screw threads 152 traverse the outer surface of the cylindrical body 142. FIG. 8 is a cross-sectional side elevation of the closure member 140, showing further structural details and its mounting in the open end of a tubular container 112. The tubular container 112 is of spiral paper construction and is of a diameter wherein the screw threads 152 on member 140 will by deformation of the walls of container 112 embed therein to form corresponding female threads. Upon rotation of the closure member 140, the closure member 140 will screw in or out of the open end of container 112, forming its own female threads as it rotates. It will be appreciated that the embodiment container shown in FIG. 8 is not a tamper-proof container, lacking the frangible means for permanently breaking the container 112 body. However, the container embodiment of FIG. 8 possesses all of the other advantages associated with the embodiments of FIGS. 3–6 as described above. In addition, as shown in FIG. 8, the closure member 140 has a downward projecting flange 147 extension 139 which forms a gap between the extension 139 and the cylindrical body 142 of member 140. The closed end of the gap may contain a sealant composition 141, which forms a vapor-proof seal with the end of container 112 when the member 140 is mounted thereon, as shown in FIG. 8. This structural feature is advantageous for packaging materials which may be sensitive to vapors such as moisture.

It will be appreciated by those skilled in the art that many modifications may be made to the above-described embodiments of the invention, without departing from the spirit and the scope of the invention. For example, although the closure members are preferably fabricated from a polymeric resin, they can be constructed of metals. Also, by selection of the pitch of the interrupted screw threads, one can provide containers which may be opened by any degree of twisting, between at least 5°–10° to 360° and more.

What is claimed:

1. An improved, tamper-proof, tubular container assembly, which comprises;

a tubular body having a closed end, an open end, a body wall with inner and outer surfaces joining said ends, and a removable body wall portion contiguous with the open end, said inner surface being deformable;

means associated with the body wall for fracturing said body wall and permanently separating the removable body wall portion, whereby access to the contents of the container assembly may be had; and a removable closure member, mounted in and closing the open end of the tubular body, said closure member comprising a hollow cylinder having (a) a first closed end;

(b) a second, beveled end, said bevel being angled toward the axis of said cylinder;

(c) a cylinder wall joining the first and second ends and having inner and outer surfaces, said outer surface being divided into a screw thread zone which is contiguous with the beveled end and an attachment zone between the screw thread zone and the first closed end; and (d) a male screw thread formed on the outer surface of the cylinder in the screw thread zone; said mounting being effected by securing the inner surface of the removable body wall portion of the tubular body to the attachment zone of the hollow cylinder, with the beveled end and screw thread zone positioned within said tubular body at a point between the closed end of the tubular body and the removable body wall portion;

the removable closure member being of a dimension whereby the screw thread will deform the inner surface of the tubular body when the removable closure member is mounted in the open end of the tubular body, and form thereon a corresponding female screw thread in which the male screw thread will slide when the removable closure member is rotated so as to screw the closure member out of the open end of the tubular body.

2. The assembly of claim 1 wherein there is a finger-grasping flange disposed about the outer periphery of the first closed end of said hollow cylinder.

3. The assembly of claim 1 wherein the male screw thread continuously circumscribes the screw thread zone.

4. The assembly of claim 1 wherein the pitch of the male screw thread is such that the thread on the screw thread zone is discontinuous, segments extending from the bevel to the attachment zone of the hollow cylinder.

5. The assembly of claim 1 wherein said means for fracturing and separating comprises a perforated seam in the body wall.

6. The assembly of claim 1 wherein the tubular body is formed of spirally-wrapped paper and the hollow cylinder is formed of a synthetic polymeric resin.

7. A tubular container assembly having a self-threading closure member, which comprises;

a tubular body having a closed end, an open end, a body wall with inner and outer surfaces joining said ends, said inner surface being deformable;

a removable closure member, mounted in and closing the open end of the tubular body, said closure member comprising a hollow cylinder having (a) a first closed end;

(b) a second, beveled end, said bevel being angled toward the axis of said cylinder;

(c) a cylinder wall joining the first and second ends and having inner and outer surfaces; and (d) a male screw thread formed on the outer surface of the cylinder in the screw thread zone;

the removable closure member being of a dimension whereby the screw thread will deform the inner surface of the tubular body when the removable closure member is mounted in the open end of the tubular body, and form thereon a corresponding female screw thread in which the male screw thread will slide when the removable closure member is rotated so as to screw the closure member out of the open end of the tubular body.

8. The assembly of claim 7 wherein there is a finger-grasping flange disposed about the outer periphery of the first closed end of said hollow cylinder.

9. The assembly of claim 8 wherein a downward extension of the finger-grasping flange forms a gap between the flange and the cylinder wall, said gap being adapted to receive the tubular body end, said gap containing therein a sealant composition for forming a vapor-proof seal with the end of the tubular container.

10. The assembly of claim 7 wherein the pitch of the male screw thread is such that the thread on the cylinder body is discontinuous.

11. The assembly of claim 7 wherein the tubular body is formed of spirally-wrapped paper and the hollow cylinder is formed of a synthetic polymeric resin.

* * * * *